US005862910A

United States Patent [19]

Dahlsten

[11] Patent Number: 5,862,910

[45] Date of Patent: Jan. 26, 1999

[54] GOLF CLUB HEAD PROTECTOR ASSEMBLY

[76] Inventor: David E. Dahlsten, 1444 Dover Rd., McPherson, Kans. 67460

[21] Appl. No.: 646,928

[22] Filed: May 8, 1996

[51] Int. Cl.[6] ..... A63B 55/00; A63B 57/00

[52] U.S. Cl. ..... 206/315.4; 206/315.6; 150/159

[58] Field of Search ..... 150/159, 160; 206/315.4, 315.6, 315.8

[56] References Cited

U.S. PATENT DOCUMENTS

| | | | |
|---|---|---|---|
| D. 256,293 | 8/1980 | Ewards | 206/315.4 X |
| 1,119,508 | 12/1914 | Headley | 206/315.4 |
| 1,325,692 | 12/1919 | Cross | 206/315.4 |
| 4,194,547 | 3/1980 | Sidor et al. | 206/315.6 |
| 4,208,227 | 6/1980 | Cowan | 206/315.6 |
| 4,263,950 | 4/1981 | Brown | 206/315.4 |
| 4,453,632 | 6/1984 | Clower | 150/160 X |
| 4,512,465 | 4/1985 | Jobe | 206/315.4 |
| 5,005,623 | 4/1991 | Webster, Jr. | 150/159 |
| 5,209,280 | 5/1993 | Gevas | 150/159 |
| 5,244,086 | 9/1993 | Welch | 150/159 X |
| 5,297,328 | 3/1994 | Reimers et al. | 206/315.8 X |
| 5,299,611 | 4/1994 | Cirone | 206/315.4 X |

FOREIGN PATENT DOCUMENTS

| | | | |
|---|---|---|---|
| 2603944 | 5/1977 | Germany | 206/315.3 |

*Primary Examiner*—Sue A. Weaver
*Attorney, Agent, or Firm*—Phillip A. Rein

[57] ABSTRACT

A golf club head protector assembly includes 1) a golf bag assembly; 2) a club protector shield member of a flexible sheet material operable to be inserted within an open bag entrance opening into the golf bag assembly and extend upwardly therefrom; 3) a bag cover enclosure assembly operable to be releasably connected to a top support section of the golf bag assembly; 4) an exterior protector cover assembly operable to be mounted about and enclose the golf bag assembly, the club protector shield member, and the bag cover enclosure assembly. The golf bag assembly is provided within the top support section with a club divider plate operable to receive and separate club shafts having the club heads extended upwardly therefrom and outwardly of a top surface of the golf bag assembly. The club protector shield member is flexible and operable to be placed in circular shapes of various diameters and to conform to oval, square, rectangular, or triangular openings into the golf bag assembly and hold its shape due to a special composition material. The club protector shield member includes an adjustable connector member so that it can be flexibly moved to various shapes and diameters and held in that shape by the adjustable connector member.

4 Claims, 3 Drawing Sheets

GOLF CLUB HEAD PROTECTOR ASSEMBLY

PRIOR ART

A patent search was conducted on the above identified invention and the following United States patents are noted:

| U.S. PAT. NO. | INVENTION | INVENTOR |
|---|---|---|
| 3,729,036 | GOLF BAG LINER | William H. McFadden |
| 4,311,178 | INTERIOR SPACE DIVIDER FOR GOLF BAG | Robert A. Kennedy |
| 4,448,305 | GOLF BAG INCLUDING STIFFENING STRUCTURE | Kim Y. Sup |
| 4,509,643 | GOLF BAG WITH A REINFORCING INSERT TUBE | Yong S. Rhee |
| 4,703,851 | COMBINATION GOLD BAG AND INSERT | Robert Stewert |
| 4,767,001 | GOLF BAG | Young S. Kim |
| 4,796,752 | CART BAG FOR GOLF | Eric W. Reimers |
| 5,431,278 | GOLF BAG WITH ADHESIVELY SECURED DIVIDER PANELS AND ADHESIVELY SECURED TUBULAR BODY | Jon J. Gretz |
| 5,458,240 | GOLF BAG WITH INDIVIDUAL CLUB HEAD SUPPORT POCKETS | Rich et al |
| 5,482,160 | GOLF BAG | Stephen J. Perrin |

The McFadden patent discloses a golf bag liner which is adjustable in diameter and having separate tube members therein for receiving and holding a golf club member in a spaced position.

The Kennedy patent discloses an interior space divider for a golf bag of a plastic construction and having six separate areas for holding various golf club members in separated areas.

The Sup and Rich et al patents disclose golf bag stiffening structures to receive, extend, and add rigidity to a flexible golf bag member and hold golf clubs in a separated condition.

The Rich et al patent discloses an upper club head support operable to receive and support golf club members in a separated, protected condition. Further, this patent discloses an upper golf bag cover to cover the golf clubs when being transported or thrown onto an airline baggage carrousel. The bag cover would prevent breakage of the golf club head members as they are completely enclosed and protected from damage.

The Stewert and Perrin patents disclose a combination golf bag and insert to provide rigidity to a flexible golf bag member.

The Kim patent discloses a golf bag which is expensive to manufacture. Kim discloses an upper protective club cover which can be clamped about an upper end to provide protection to golf club members from breakage during airline transportation.

The Reimers patent discloses a cart bag for golf having an upper rigid insert or collar to receive and provide rigidity to the golf bag.

The Gretz patent discloses a golf bag and provides an insert member or top cap to be secured to an upper end of a golf bag to provide protection to the golf clubs mounted therein.

PREFERRED EMBODIMENT OF THE INVENTION

In one preferred embodiment of this invention, a golf club head protector assembly of this invention includes 1) a conventional golf bag assembly operable to receive and support a plurality of golf clubs therein; 2) a club protector shield member which is insertable into a golf club entrance opening of the golf bag assembly and extended laterally therefrom; 3) a bag cover enclosure assembly operable to be releasably mounted about the entrance opening into the golf bag assembly and having a zipper member which can be opened for access to the golf clubs therein; and 4) an exterior protector cover assembly operable to be mounted about the golf bag assembly, the club protector shield member, and the bag cover enclosure assembly.

The exterior protector cover assembly is operable to provide an outer protection against the weather and during shipment on a commercial transport vehicle to prevent damage to a leather golf bag assembly, golf clubs, etc.

The golf bag assembly is of a conventional type having a main body member with a central hand support member and a shoulder support strap connected thereto to be carried about one's shoulder during a game of golf play by a golf player or a caddy.

The main body member is provided with a top support section having a plurality of snap receiver members thereabout and a club divider plate mounted internally thereof. The club divider plate is of a conventional nature having a plurality of club receiving openings therein to maintain the golf clubs therein in a spaced, non-contacting relationship.

The club protector shield member is of a flexible sheet material having a main shield body section with adjustable connector members connected thereto. The main shield body section is generally of a rectangular shape and includes a top edge, spaced parallel side edges, and a bottom edge having mounted centrally thereof a laterally extended tab lock insert portion.

The club protector shield member is constructed of a special chemical composition comprising a combination of a high-density polyethylene material with a synthetic rubber compound material. The proper combination of these elements achieves a combination of the elements to achieve the special chemical composition of superior characteristics having 1) sufficient stiffness to provide adequate protection for the golf clubs; 2) proper flexibility to allow the club protector shield member to conform to any oval, square, circular, or triangular shape to conform to a shape of the golf club entrance opening into the golf bag assembly; and 3) a material that would not lose its physical properties with age and would retain its stiffness, flexibility, and shape retaining properties.

The bag cover enclosure assembly includes a cover body member having a lower connector section and an access opening slot. The access opening slot has a zipper closure member connected thereto to selectively open and close an entrance access thereto.

The lower connector section is provided with a plurality of circumferentially spaced anchor male snap members operable to be selectively connected to the snap receiver members on the top support section of the main body member of the golf bag assembly.

The exterior protector cover assembly is of a known construction, normally constructed of a waterproof durable plastic material, and includes an exterior cover member having a conveyance handle connected thereto.

The exterior cover member has an access split opening to which is connected a cover closure zipper member to selectively open and close the access split opening. The exterior cover member provides a water and dust proof exterior to protect the golf bag assembly, the bag cover enclosure assembly, and the golf clubs contained therein.

In this enclosed condition with the exterior protective cover assembly, the assembled golf club head protector assembly is ready to be carried within a trunk of an automobile vehicle or in the cargo area of a commercial transport vehicle such as an airplane during travel conditions.

The golf club head protector assembly of this invention having a main feature being the club protector shield member was devised in order to provide a protective means to the upper ends of golf clubs with putter heads and driver heads to prevent breakage thereof. This golf club breakage occurs commonly during airline travel in throwing the golf bag assembly onto airplane cargo bays and onto cargo conveyance carrousels at airports. The reason why this is important is that today most golfers use expensive golf clubs having graphite golf club shafts which improve a golf game. However, these graphite golf club shafts are brittle and easily broken on receiving a side impact thereto and breaks around an outer club shaft and adjacent club head connection areas. When these clubs are broken, it is very expensive to have them repaired and/or replaced.

Further, an important feature of the golf club head protector assembly of this invention is that the club protector shield member is adjustable and can be placed within various 8", 9", or 10" diameter openings into the golf bag assembly. Due to the unique chemical composition of the club protector shield member, it will retain its shape when placed and expanded within oval, square, rectangular, and triangular shaped openings into the golf bag assembly.

OBJECTS OF THE INVENTION

One object of this invention is to provide a golf club head protector assembly utilizing 1) a golf bag assembly having a golf club entrance opening; 2) a club protector shield member which is inserted into the golf club entrance opening and extends substantially upwardly therefrom; 3) a bag cover enclosure assembly mounted about an outer end of the golf bag assembly to enclose the protruding golf club members and the club protector shield member surrounding the club heads of the golf club members; and 4) an exterior protector cover assembly operable to be mounted about the golf bag assembly, the club protector shield member, and the bag cover enclosure assembly and to be placed in a zippered enclosed condition to protect the elements therein from exterior damage and contamination.

Another object of this invention is to provide a golf club head protector assembly having a golf bag assembly with a plurality of golf clubs therein having outer club heads extending outwardly of an entrance opening thereto and a club protector shield member mounted within and engageable with the entrance opening of the golf bag assembly and extended upwardly from the outer club heads of the golf club members to provide protection from impact against the club heads when being thrown into an airline baggage carrousel or a cargo area on an airplane.

One other object of this invention is to provide a golf club head protector assembly constructed of a unique chemical composition and being flexible and held in a desired shape by an adjustable connector member and operable to hold its shape whether in a circular, oval, square, rectangular, or triangular shape.

A further object of this invention is to provide a golf club head protector assembly of a sheet material operable to be coiled in a given shape and held in this shape by adjustable connector members and being both resilient and flexible in operation and operable to conform to various shapes of an entrance opening into a golf bag assembly.

One further object of this invention is to provide a golf club head protector assembly having a club protector shield member which can be coiled and adjustably locked by Velcro connector members in a given circular shape so as to be placed within golf bag openings of 8", 9", and 10" diameters.

Still, one other object of this invention is to provide a golf club head protector assembly having a club protector shield member made of a unique chemical composition material which is easy to coil or manipulate in a given diameter or shape; which has adjustable connector members to hold same in a given, adjusted position; which is constructed of a high-density polyethylene and synthetic rubber compound to achieve a combination chemical composition so as to have sufficient stiffness and provide adequate protection to outer exposed portions of the club heads of the golf club members above a top surface of an entrance opening to a golf bag assembly; which has proper flexibility to conform to any shape of an entrance opening to a golf bag assembly; which is of a material that will not lose its physical characteristics with age; economical to manufacture; readily utilized and not requiring any skill for placement in the open entrance opening into the golf bag assembly; and which is substantially maintenance free.

Various other objects, advantages, and features of the invention will become apparent to those skilled in the art from the following discussion, taken in conjunction with the accompanying drawings, in which:

FIGURES OF THE INVENTION

Figure 1:
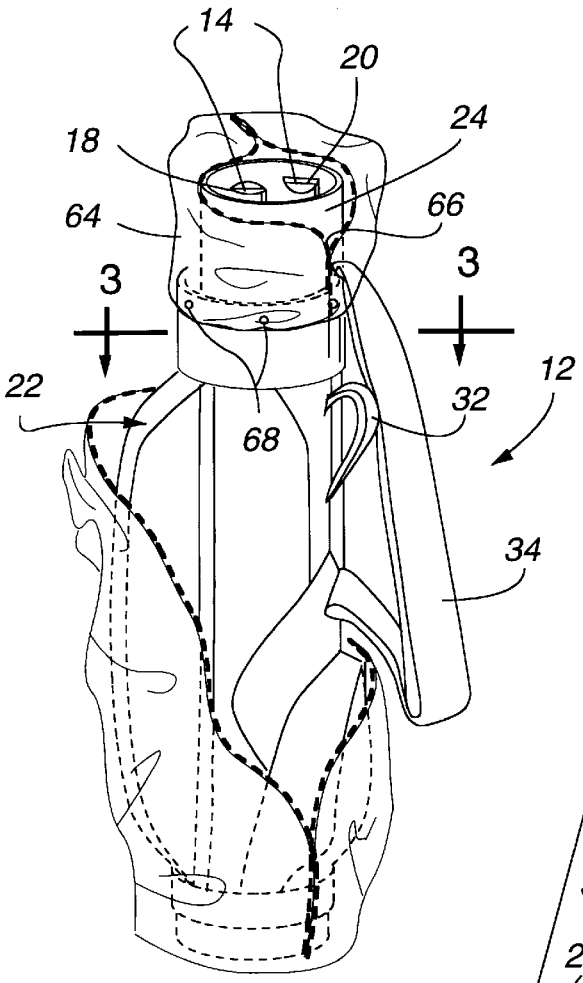
FIG. 1 is a perspective view of the golf club head protector assembly of this invention in an assembled condition with enclosure members in unzipper conditions for clarity.

The following is a discussion and description of preferred specific embodiments of the golf club head protector assembly of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

On referring to the drawings in detail, and in particular to FIG. 1, a golf club head protector assembly of this invention, indicated generally at 12, is utilized to prevent damage to golf clubs 14, each having a club shaft 16 connected to a golf club head 18 which may be a putter club head, irons, or a driver head 20. An opposite end of the club shafts 16 are connected to handle sections (not shown) and are placed within a golf bag assembly 22 as will be noted.

The golf club head protector assembly 12 includes 1) a golf bag assembly 22 operable to receive and hold the golf clubs 14 therein; 2) a club protector shield member 24 to be mounted within an opened entrance opening in to the golf bag assembly 22 and extended upwardly therefrom; 3) a bag cover enclosure assembly 26 operable to be connected to an upper end of the golf bag assembly 22 and enclose the club protector shield member 24; and 4) an exterior protector cover assembly 28 operable to be mounted about and enclose the golf bag assembly 22 and golf clubs 14 therein, the club protector shield member 24, and bag cover enclosure assembly 26.

Figure 2:
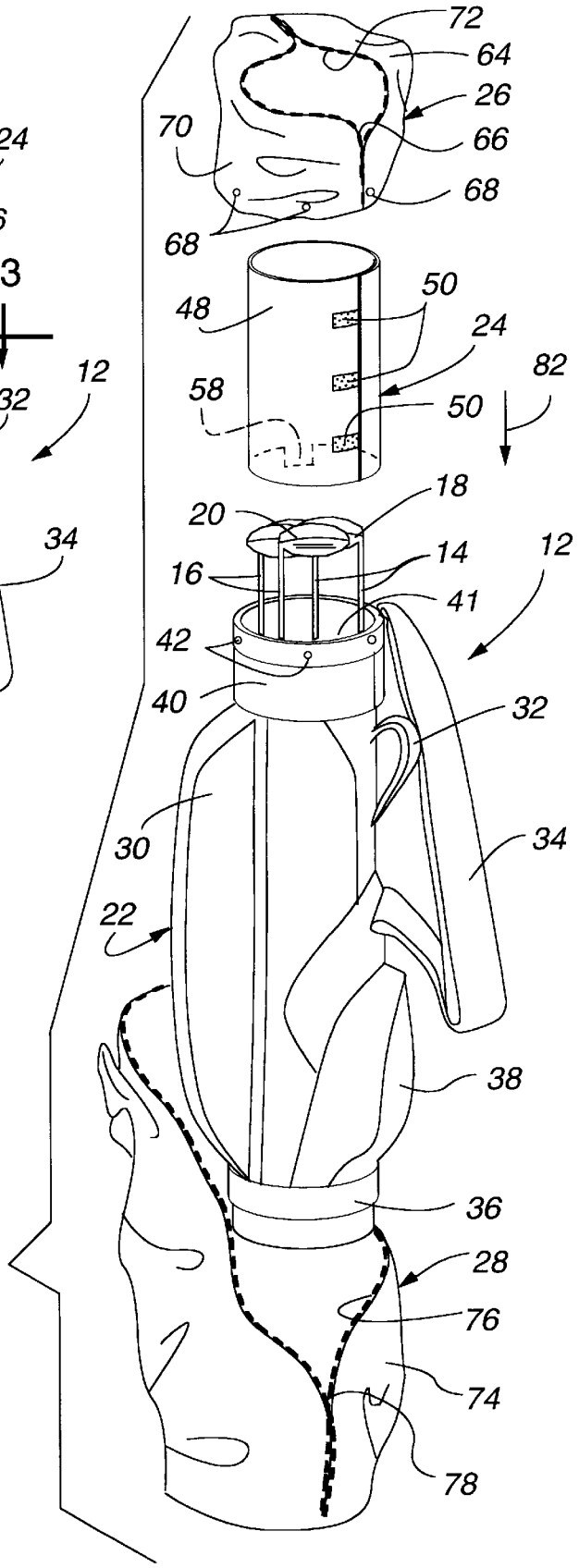
FIG. 2 is a perspective view similar to FIG. 1 but having the elements therein shown in an exploded perspective.

As noted in FIG. 2, the golf bag assembly 22 includes a main body member 30 having a handle support member 32 and a shoulder support strap member 34 connected to an exterior surface thereof.

The main body member 30 includes 1) a bottom support section 36; 2) an enclosure body section 38 having one end connected to the bottom support section 36; and 3) a top support section 40 secured to an upper end of the enclosure body section 38.

Figure 3:
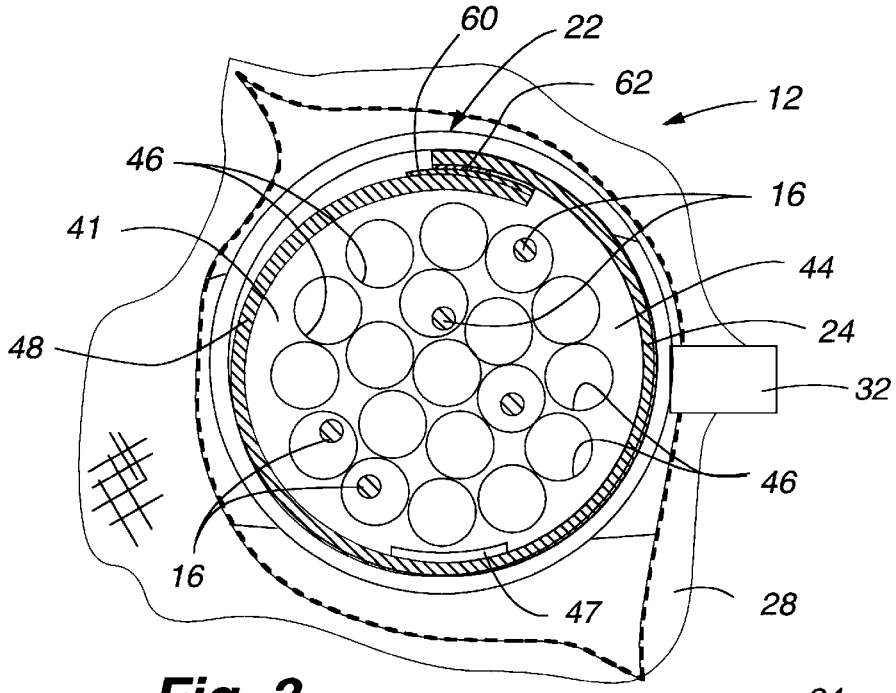
FIG. 3 is an enlarged sectional view taken along line 3—3 in FIG. 1.

The top support section 40 includes 1) an upper bag entrance opening 41; 2) snap receiver members 42 mounted about an upper, outer periphery thereof; and 3) a club divider plate 44 extended across an upper area of the top support section 40 as noted in FIG. 3. The club divider plate 44 is provided with a plurality of adjacent but spaced club receiver openings 46 and a shield insert slot 47.

The club receiver openings 46 are operable to selectively receive the handle section and the club shaft 16 therethrough to hold the upper club heads 18 in a spaced non-contacting condition.

The club protector shield member 24 is constructed of a sheet material including a main shield body section 48 having spaced ones of adjustable connector members 50 secured thereto. The main shield body member 48 is provided with 1) a top edge 52; 2) spaced parallel side edges 54; 3) a bottom edge 56; and 4) a tab lock insert portion 58 connected to a center portion of the bottom edge 56 and laterally extended from the main shield body section 48.

Figure 4:
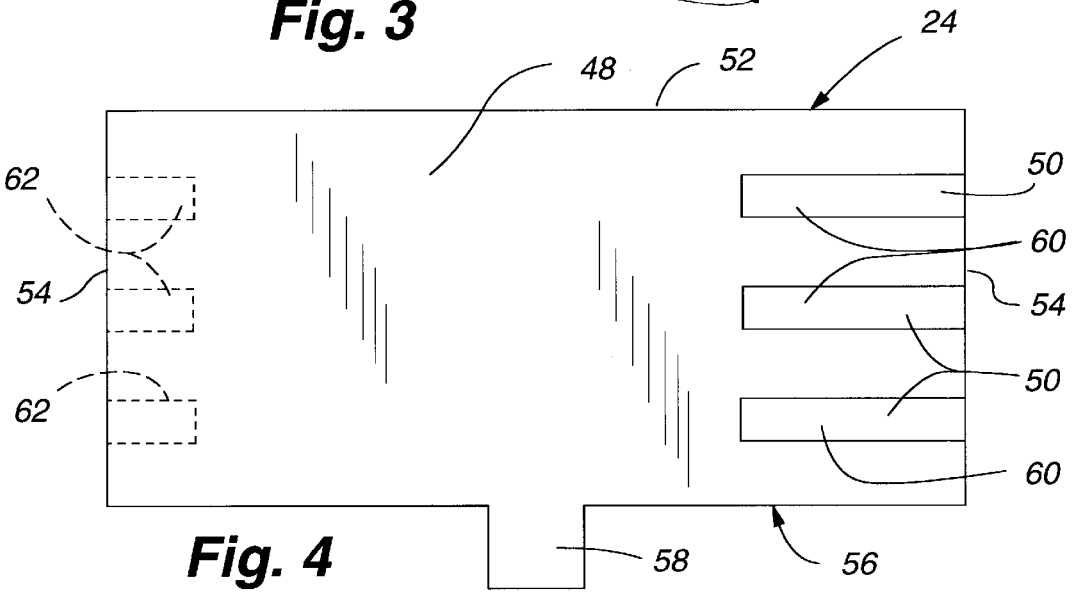
FIG. 4 is an elevational view of one side of a club protector shield member of this invention.

The adjustable connector members 50, being three thereof, are of a known Velcro connector assembly having 1) three adjacent parallel spaced loop connector sections 60 adjacent one side edge 54; and 2) respective adjacent hook connector sections 62 being spaced and parallel about an opposite side edge 54 as noted in FIG. 4.

The loop connector sections 60 are of a sufficient length so as to provide an adjustable feature when operably connected to the hook connector sections 62 as will be explained.

The main shield body section 48 is of a special, unique chemical composition which is the combination of a high-density polyethylene material in combination with a synthetic rubber compound. The high-density polyethylene material gives excellent stiffess properties but, by itself, does not have good flexibility properties. This material would form into a round shape and would not conform to a sharp radius corner of a square or triangular shaped golf bag assembly 22. Further, the high-density polyethylene material will become quite brittle as the material ages or is used in cold weather conditions.

The synthetic rubber compound material gives the flexibility required to conform to any shape of the bag entrance opening 41 of the golf bag assembly 22 and this material is not brittle plus ensures long-term retention of physical properties.

The applicant herein has experimented and developed a proper mixture of the high-density polyethylene material and synthetic rubber compound to receive the desired characteristics of the main shield body section 48 of the club protector shield member 24 which achieves the follows:

"The combination of the polyethylene material and the synthetic rubber compound is known to create the main shield body section 48 having a memory characteristic being biased to return to its last shape whether it is flat for conveyance and storage purposes or cylindrical oval shaped for insertion into the upper bag entrance opening 41 of the golf bag assembly 22."

(1) sufficient stiffness to provide adequate protection for the exposed portion of the club heads 18 of the golf clubs 14 extended upwardly and outwardly above the bag entrance opening 41 into the main body member 30;

(2) provides proper flexibility which would allow the club protector shield member 24 to conform to any shape of the bag entrance opening 41 into the main body member 30 of the golf bag assembly 22; and (3) provides a material that would not lose its physical properties with age and would retain its stiff-ness and flexibility properties over a long time period.

The bag cover enclosure assembly 26 includes a cover body member 64 having connected to an outer surface 1) a zipper closure member 66; and 2) anchor male snap members 68. The cover body member 64 may be constructed of a plastic or leather material and includes a lower connector section 70 and having an elongated access opening slot 72.

The zipper closure member 66 is connected to opposite edges of the access opening slot 72 and is operable in a conventional manner to selectively open and close the access opening slot 72.

The lower connector section 70 of the cover body member 64 has the anchor male snap members 68 placed in circumferential spaced positions thereabout and are operable to be selectively engaged with the snap receiver members 42 on the top support section 40 of the main body member 30 of the golf bag assembly 22 as will be explained.

The anchor male snap members 68 and the snap receiver members 42 are engaged to provide an enclosure structure about the club heads 18 of the golf clubs 14 and an open upper area of the club protector shield member 24.

The exterior protector cover assembly 28 is of a conventional nature which is constructed normally of waterproof flexible material and is provided with an exterior cover member 74 having a conveyance handle (not shown) connected thereto.

The exterior cover member 74 has an access split opening 76 which is selectively opened and closed by a cover closure zipper member 78 operable to seal and release opposing edges of the access split opening 76 in a conventional manner.

USE AND OPERATION OF THE INVENTION

In the use and operation of the golf club head protector assembly 12 of this invention, the golf bag assembly 22 would have the club divider plate 44 mounted within the upper bag entrance opening 41 of the top support section 40 and placed slightly downwardly therein as noted in FIG. 3. The club shaft 16 and handle section are thereupon placed within respective ones of the club receiver openings 46 in a spaced relationship so that the upper club heads 18 are not in contact with each other.

Numerous other types of club divider plates 44 may be utilized having intersecting vertical plates to divide the tipper area of the top support section 40 into separate compartments. Each separate compartment will be utilized with the same purpose and function as the club receiver openings 46, namely, separating the club heads 18 of the golf clubs 14 to prevent contact and damage therebetween.

Figure 5:
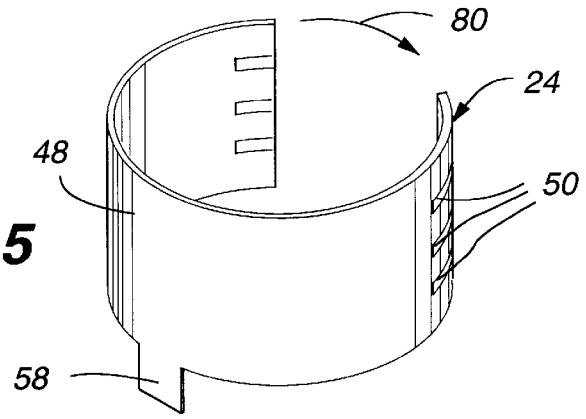
FIG. 5 is a perspective view of the club protector shield member being moved to a coiled usage position of a desired shape and size.
Figure 6:
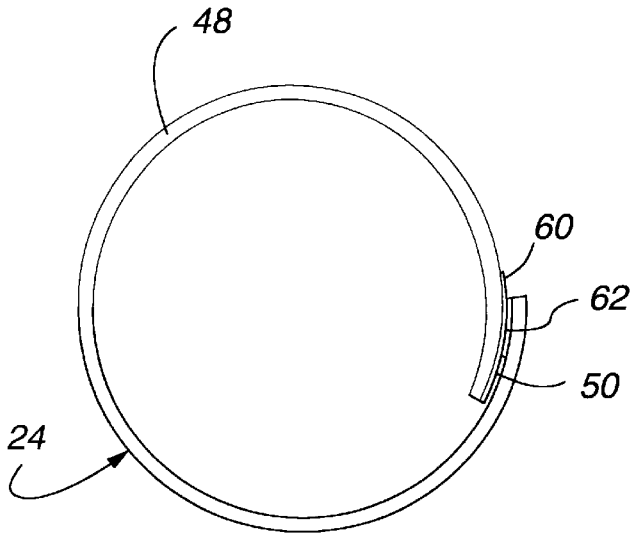
FIG. 6 is a top plan view of the club protector shield member in a circular coiled condition.
Figure 7:
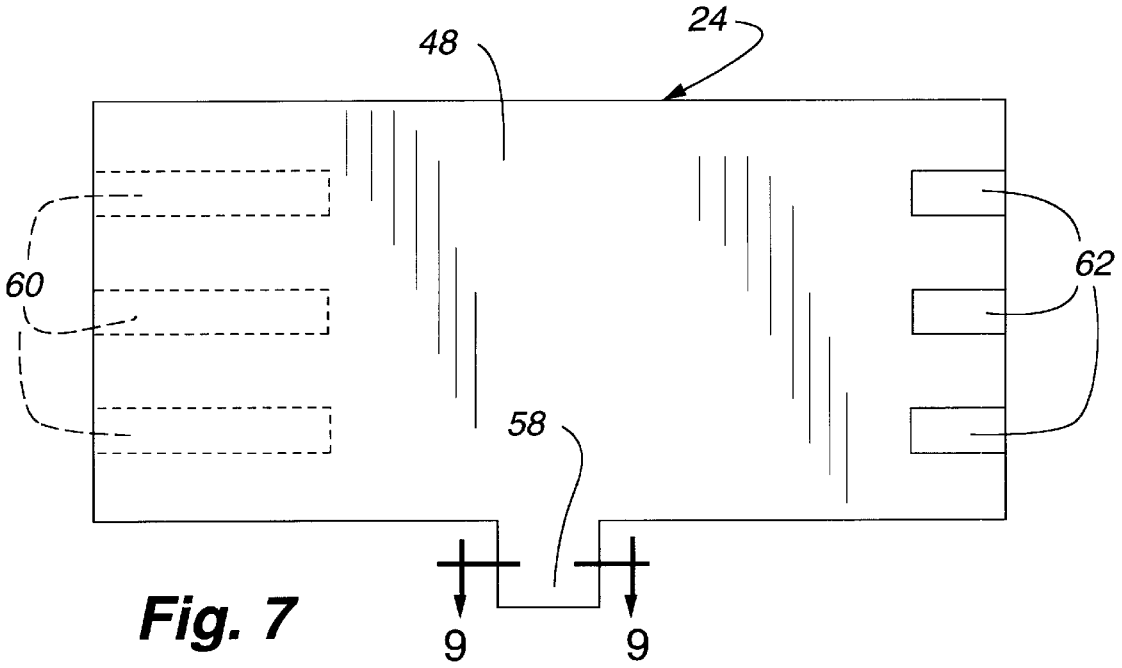
FIG. 7 is an elevational view of the opposite side of the club protector shield member as illustrated in FIG. 4.
Figure 8:
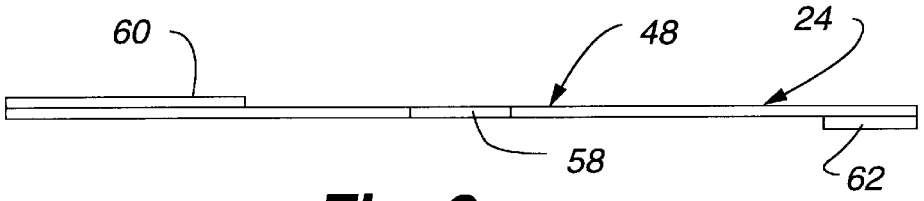
FIG. 8 is a bottom plan view of the club protector shield member.
Figure 9:
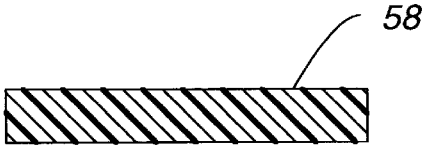
FIG. 9 is a sectional view taken along line 9—9 in FIG. 7.

Next, the club protector shield member 24 may be moved to a circular condition of a proper diameter as noted by an arrow 80 in FIG. 5. In this proper circular condition, it is noted that the adjustable connector members 50, being three thereof, are interconnected by the hook connector section 62 connected to respective ones of the loop connector section 60 to hold in the coiled condition as noted in FIG. 6.

At this time, a lower section of the coiled club protector shield member 24 is moved downwardly and inserted into the bag entrance opening 41 as noted by an arrow 82 in FIG. 2.

On insertion therein, the tab lock inset portion 58 of the main shield body section 48 is mounted within the shield insert slot 47 as noted in FIG. 3 which will hold the club protector shield member 24 against rotation therein. This also allows the bottom edge 56 of the main shield body section 48 to rest on a peripheral upper top surface of the club divider plate 44.

It is noted that, because of the adjustable connector members 50, the main shield body section 48 can be formed in various diameters to easily fit within bag entrance openings 41 of various diameters such as 8", 9"and 11" bag openings merely by using the adjustability feature of the adjustable connector members 50.

Next, the user would place the bag cover enclosure assembly 26 over the club protector shield member 24 protecting the club heads 18 of the golf clubs 14 therein. the bag cover enclosure assembly 26 is moved downwardly so as to have the lower connector section 70 adjacent an outer end of the top support section 40 of the golf bag assembly 22. In this position, the zipper closure member 66 would be moved to a closed condition to close the access opening slot 72.

Next, the anchor male snap members 68 would be aligned with respective ones of the snap receiver members 42 which would be connected to each other in a conventional manner to provide a protective, sealed enclosure thereabout.

The bag cover enclosure assembly 26 would have an upper top surface engageable against an upper top open area of the club protector shield member 24 so as to prevent the club heads 18 of the golf clubs 14 from projecting upwardly and laterally from the top open area.

Finally, the user would mount the interconnected golf bag assembly 22, club protector shield member 24, and bag cover enclosure assembly 26 through the access split opening 76 of the exterior protector cover assembly 28.

Next, exterior cover member 74 is drawn upwardly and over a top area of the bag cover enclosure assembly 26 and the cover closure zipper member 78 is operable to bring opposite sides into an secured enclosed condition of the access split opening 76 in a conventional manner.

At this time, this entire assembled golf club head protector assembly 12 can be utilized by a conveyance handle (not shown) for conveying same to a vehicle or from a vehicle into an airport check-in area whereupon it is to be placed on a conveyor belt to be loaded in an airplane.

The conveyor belt would carry the golf club head protector assembly 12 outwardly to a baggage area for loading into an airplane cargo bay area. It is noted that the club heads 18 of the golf clubs 14 within the golf bag assembly 22, without the club protector shield member 24, are extended laterally upwardly therefrom. The club heads 18 are subject to severe lateral impact during handling by cargo loader personnel at airports and other commercial transport operations. There are many cases where the club shafts 16 have been snapped during loading and unloading operations on an airplane or other commercial transport vehicles such as buses and trains.

The repair or replacement of club shafts 16 on golf clubs 14, when made of a graphite composition, is very expensive and time consuming. The golf club protective shield member 24 is a low cost, flexible, easy means of providing protection to the club heads 18 on club shafts 16 to prevent breakage thereof.

It is noted in the prior art that there are other devices used to provide protection to golf clubs 14 and prevent breakage of the club shafts 16, such as a rigid plastic outer encasement structure, and are very expensive compared to the low cost club protector shield member 24 of this invention.

The golf club head protector assembly of this invention is economical to manufacture; providing sufficient stiffness to provide protection to the exposed outer club heads on golf clubs; providing proper flexibility which would allow the club protector shield member to conforn to various shapes of bag entrance openings into a golf bag assembly; constructed of a material that does not lose its physical properties with age and retains the stifflness and flexibility over a long time period; easily adjustable to fit bag entrance openings of various sizes and shapes; easily installed, not requiring skilled labor for placement within the bag entrance opening of a golf bag assembly; and substantially maintenance free.

While the invention has been described in conjunction with preferred specific embodiments thereof, it will be understood that this description is intended to illustrate and not to limit the scope of the invention, which is defined by the following claims:

I claim:

1. A golf club head protector assembly adapted to prevent breakage of golf club heads from respective golf club shafts on impact during baggage movement on commercial transport operations, comprising:

a) a golf bag assembly having a golf bag entrance opening adapted to receive golf clubs therein with golf club heads and portions of respective club shafts extended laterally therefrom;

b) a club protector shield member coiled about a longitudinal axis having overlapping end portions and mounted within said golf bag entrance opening and having an outer end portion extended laterally of said golf bag entrance opening and surrounding the golf club heads;

c) said golf bag assembly having a club divider plate mounted therein positioned downwardly from said golf bag entrance opening;

d) said club protector shield member having a bottom edge resting on said club divider plate to hold in a desired elevated position, and said club protector shield member extended laterally from said golf bag entrance opening to protect the golf clubs mounted within said golf bag assembly;

e) said club protector shield member having a tab lock insert portion extended laterally of said bottom edge engageable with a portion of said club divider plate to hold therein in a proper position and prevent rotation thereof;

f) said club protector shield member having a connector member operable to secure said overlapping, coiled, end portions of said club protector shield member to each other and operable to hold in a given shape conforming to said golf bag entrance opening; and g) said club divider plate includes a shield insert slot to receive said tab lock insert portion therein to prevent rotation of said club protector shield member;

whereby said club protector shield member protects the golf club heads against impact and prevents breakage of the respective golf club shafts.

2. A golf club head protector assembly, comprising:

a) a golf bag assembly having a golf club entrance opening;

b) a club protector shield member constructed of a flexible sheet material and having an adjustable connector member connected thereto;

c) said club protector shield member movable to a coiled shape to conform to a configuration of said golf club entrance opening which may be circular, square, rectangular, triangular, or irregular;

d) said adjustable connector member holds adjacent, overlapping coiled portions of said club protector shield member in said shape conforming to said configuration of said golf club entrance opening;

e) said club protector shield member having a main shield body with a plurality of said adjustable connector members connected thereto and having an integral, tab lock insert portion extended laterally of said main shield body;

f) said tab lock insert portion, when positioned within the golf club entrance opening, is engageable with a club divider plate inside the golf club entrance opening and operable to limit rotational movement of said main shield body within said golf club entrance opening;

g) said golf bag assembly having said club divider plate mounted therein positioned downwardly from said golf club entrance opening; and h) sad club divider plate having a shield insert slot to received said tab lack insert portion therein to prevent rotation of said club protector shield member.

3. A means to protect golf clubs while carried with a golf bag assembly from breakage which occurs when being tossed about during baggage handling during commercial transport operations, comprising:

a) a club protector shield member constructed of a flexible sheet material including a main shield body section having a connector member mounted thereon;

b) said club protector shield member constructed of a combination plastic and synthetic rubber compound to achieve a composition material;

c) said club protector shield member is coiled about a longitudinal axis and movable to round, square, rectangular, or triangular coiled shape and held in said coiled shape interconnecting adjacent overlapping portions of said club protector shield member by said connector member;

d) said club protective shield member having a main shield body section with a bottom edge and a tab lock insert portion extended laterally of said bottom edge;

e) said tab lock insert portion mounted within an entrance opening into a golf bag assembly and engageable with a portion of the golf bag assembly adjacent the entrance opening and being operable to limit relative rotation thereof on engagement with the portion of the golf bag assembly; and f) the portion of the of bag assembly is a club divider plate having an opening to receive said tab lock insert portion therein to limit relative rotation of said club protector shield member.

4. A golf club protector assembly adapted to prevent breakage of golf club heads from respective golf club shafts on impact during baggage movement on commercial transport operations, comprising:

a) a golf bag assembly having a golf bag entrance opening adapted to receive golf clubs therein with golf club heads and portions of respective club shafts extended laterally therefrom;

b) a club protector shield member mounted within said golf bag entrance opening and having an outer end portion extended laterally of said golf bag entrance opening and surrounding the golf club heads;

c) said golf bag assembly having a club divider plate mounted in said golf bag entrance opening;

d) said club protector shield member having a bottom edge adapted to rest on said club divider plate to hold in a desired elevated position, and said club protector shield member extended laterally from said golf bag entrance opening to protect the golf clubs mounted within said golf bag assembly; and e) said club protector shield member having a tab lock insert portion extended laterally of said bottom edge engageable with a portion of said club divider plate to hold therein in a proper position and prevent rotation thereof; and f) said club divider plate includes a shield insert slot to receive said tab lock insert portion therein to prevent rotation of said club protector shield member whereby said club protector shield member protects the golf club heads against impact and prevents breakage of the respective golf club shafts.

* * * * *